United States Patent [19]

Melarvie

[11] 4,293,957

[45] Oct. 13, 1981

[54] WET SUIT

[76] Inventor: Joel D. Melarvie, Box 1977, 304 E. Rosser, Bismarck, N. Dak. 58501

[21] Appl. No.: 115,355

[22] Filed: Jan. 25, 1980

[51] Int. Cl.[3] ..... A62B 17/00

[52] U.S. Cl. ..... 2/2.1 R; 2/79; 2/275

[58] Field of Search ..... 2/2.1 R, 2.1 A, 2, 79, 2/275

[56] References Cited

U.S. PATENT DOCUMENTS

| | | | |
|---|---|---|---|
| 2,383,261 | 8/1945 | Kronhaus | 2/2.1 R |
| 2,391,282 | 12/1945 | Van Orman | 2/2.1 R |
| 3,026,522 | 3/1962 | Di Julio | 2/2.1 R |
| 3,369,263 | 2/1968 | Kreckl | 2/2.1 A |
| 3,417,406 | 12/1968 | Rosenbaum | 2/2.1 R |
| 3,771,169 | 11/1973 | Edmund | 2/79 X |

*Primary Examiner*—H. Hampton Hunter

*Attorney, Agent, or Firm*—Berman, Aisenberg & Platt

[57] ABSTRACT

A wet suit for underwater use is constructed to yield more readily to movements of the wearer by providing one or more longitudinal slits, as for example in the arm and leg portions of the suit, and closing each of these slits with an overlying length of elastic fabric sewn to both slit edges and a sealing flap of waterproof material underlying the slit and sewn to one edge. A similarly sealed slit is provided in the trunk of the suit, and closed by a length of elastic fabric in which a zipper is sewn.

12 Claims, 3 Drawing Figures

FIG. 1
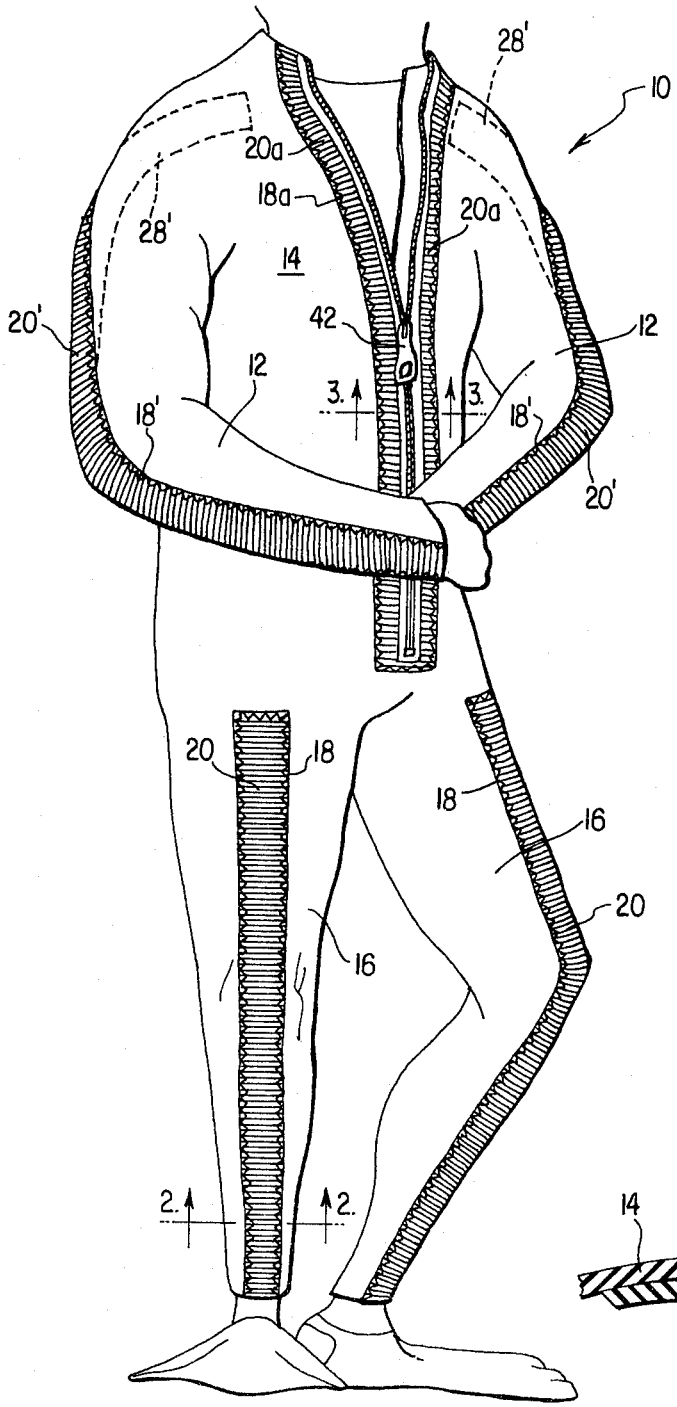
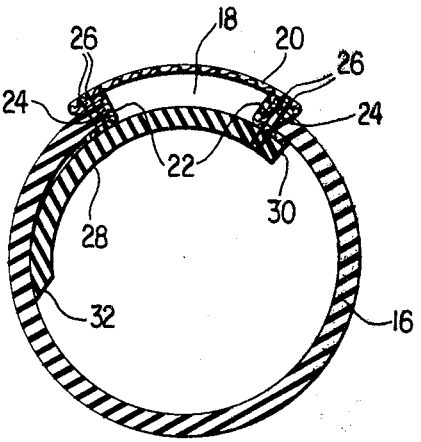
FIG. 2
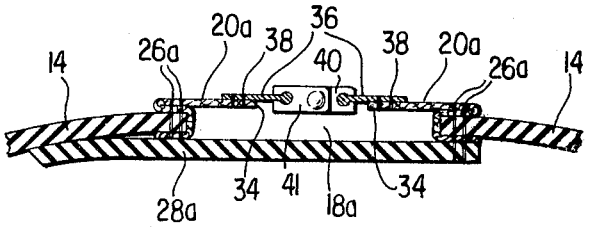
FIG. 3

WET SUIT

FIELD OF THE INVENTION

The invention relates to wet suits for underwater use and, more particularly, to an improved suit having portions which expand and contract readily in response to movements of the wearer.

BACKGROUND OF THE INVENTION

It is common practice for underwater divers, explorers and swimmers to wear a closely fitting, waterproof, protective suit made of relatively heavy and relatively nonelastic neoprene, rubber, vinyl, styrene or other like material. These suits conform closely to the body contours of the wearer leaving a thin air film between the skin and the suit which protects the wearer from cold in deep dives, or icy waters.

Conventional wet suits have certain disadvantages, foremost of which is their tendancy to quickly drain the wearer of energy. This is because they are relatively inelastic and cling closely to the body requiring considerable effort to move the arms and legs in swimming and walking under water. Because of their tightness, wet suits are difficult to put on and take off, and if the wearer gains weight this difficulty is increased to the point, in some instances, where the suit will no longer stretch to accommodate the wearer.

SUMMARY OF THE INVENTION

It is, therefore, a primary object of the invention to provide an improved wet suit which overcomes the defects and disadvantages of conventional wet suits as briefly outlined above.

It is an important object of the invention to provide a wet suit having portions which yield readily to necessary body movements of the wearer while underwater, thus saving energy of the user.

It is a further important object of the invention to provide a wet suit with expandable and contractable portions, which portions nevertheless preserve their water tightness.

Yet another object of the invention is to provide a wet suit having a split and zippered truck portion, the said split being stretchably closed by an elastic fabric sewn to the zipper halves and a sealing flap underlying the split, so as to render the suit easier to put on and take off and to continue to fit the owner even after his gain or loss of weight.

It is a still further object of the invention to provide a wet suit having the above described characteristics, which is of simple construction, easy and inexpensive to make, and simple as well as pleasurable to use.

These and other objects of the invention are achieved by forming elongated slits in the arm, leg and trunk portions of a conventional wet suit, and closing each slit by a length of elastic fabric secured to both edges of the slit, and a sealing flap underlying the slit and fabric, and secured to one edge of the slit. Where the slit is to include a zipper, the zipper halves are sewn to a pair of strips of elastic fabric which are sewn to the edges of the slit.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of a specific embodiment, when read in connection with the accompanying drawings, where like reference characters indicate like parts throughout the several Figures, and in which:

FIG. 1 is a perspective view of a wet suit according to the invention shown as being worn on the body of a user;

FIG. 2 is an enlarged sectional view through one leg of the suit taken along line 2—2 of FIG. 1 and looking in the direction of the arrows; and FIG. 3 is an enlarged, fragmentary, sectional view taken along line 3—3 of FIG. 1 and looking in the direction of the arrows.

DESCRIPTION OF THE PREFERRED EMBODIMENT

Referring now more particularly to the drawings, the improved wet suit, generally characterized by reference numeral 10, is shown as conforming closely to the shape of a wearer and having the usual arm portions 12, 12, body or trunk portion 14 and leg portions 16, 16. The suit 10 is formed from any flexible, slightly resilient, water tight material such as neoprene, styrene, butadiene, vinyl, or rubber as is commonly used in making conventional wet suits. The suit fits the body of the wearer closely maintaining a thin air space all around the body so as to keep the wearer warm and dry. With conventional construction, the suit offers a great deal of resistance to necessary body movements underwater while walking or swimming, and the wearer in moving his arms and legs against the heavy resistance of the suit soon tires.

To minimize such suit resistance to movements, and to provide a better fit, the suit 10 is provided with a pair of elongated slits 18, 18 in the legs 16, preferably extending nearly from the hips, centrally over the knee caps down to the ankle portions of the legs 16. A length of elastic fabric 20 is then inserted in each slit 18 and secured thereto by gluing or sewing, or by both gluing and sewing the edges of the fabric to the edges of the slit. The construction is best seen in FIG. 2 in which fabric 20 overlies the slit 18 and the fabric edges are bent and reversed to form a U-shaped section 22 which closely surrounds the edge 24 of the slit 18 and is glued thereto. In addition part 22 is sewn by stitches 26 to the slit edge 24.

The strips of elastic material 20 may be formed of any woven, or knitted fabric, which is resistant to corrosive elements of salt water, and which has a resilience and stretchability much greater than the neoprene, rubber or other material forming the rest of the suit. Particularly suitable for the stretch fabric are those fabrics made of rubberized fibers, whether natural, or artificial such as stretchable plastics. The elastic inserts or covers 20 allow the slits 18 to widen considerably and to lengthen to some degree when the wearers knees are bent in walking and swimming.

Since the elastic insert 20 is not waterproof, the slits 18 are sealed by a pair of flaps 28, 28 which underlie the slits 18 and are each glued along one edge 30 to one edge of the slit. The same edge is desirably sewn by the same threads 26 which secure the elastic strip 20 to the slit. The other edge 32 of flap 28 is left unsecured and merely frictionally engages the inner surface of the leg portion 16. The flaps 28 are preferably formed of the same water tight material as that forming suit 10, and because they are considerably wider than elastic strips 20, especially at the center of the flap in the knee area, the edges of the slit 18 may spread considerably apart without uncovering the flap, so that a water tight seal is maintained at flap edge 32. In FIG. 2, edge 30 of the flap is shown as square while the opposite edge 32 is shown as angled. This is merely a matter of comfort or preference. If desired both edges may be square or both may be angled.

In FIG. 1, the arm portions 12, 12 are provided with elongated slits 18', 18' which extend from the shoulders and back of the garment 10 over the backs of the elbows to the wrist areas. These slits are covered by elastic fabric inserts 20', 20' and flaps 28', 28' similar to those shown in FIG. 2 as being inserted in the leg portions 16, 16.

Another and single slit **18*a* extends down the front of the suit trunk 14 from the neck to nearly the crotch. Slit 18*a* is covered by a strip of elastic fabric 20*a* which is sewn at 26*a* and glued to the edges of slit 18*a* in the same manner as described for elastic strips 20. The slit 18*a* is sealed by a wide flap 28*a* sewn at one edge by threads 26*a* to one edge of the slit 18*a*, see FIG. 3. The elastic strip 20*a* is slit centrally along its entire, or nearly entire, length as seen at 34 and the two halves 36, 36 of a zipper cloth are sewn at 38, 38 to the edges 34,34 of the elastic. The zipper parts 40, 41 are operated by handle 42, FIG. 1, to open and close the elastic strip 20*a***.

The improved wet suit 10, as described above, is put on and taken off in the same manner as a conventional wet suit. However, the stretchability of the zipper elastic seam **20*a* and the leg and arm seams 20 and 20' make it easier to slip the suit on and off. The zippered stretch seam 20*a*** gives so that the suit will fit even after the owner has gained weight, and a given suit will fit individuals having a range of girths, ie; thin, medium or stocky.

In use of the suit 10, the stretchable seams 20 and 20' yield during walking and swimming motions of the arms and legs and minimize the resistance to these motions, so that the wearer is much more comfortable and expends much less energy in a given time. During such motions the suit splits 18 and 18' and the elastic fabrics 20 and 20' spread and contract, but water is prevented from reaching the body of the wearer by the sealing flaps 28 and 28' which remain under the spreading edges of the splits. If desired these flaps may be widened in the areas of the knees and elbows where the spreading of the elastic seam is greater.

It should be apparent that the comfort, yieldability and reduction in binding of the described wet suit make the suit more attractive to use elsewhere than underwater where protection from cold water and buoyancy are needed, as for example in other water sports such as sailing and skiing, and in sports near water such as duck hunting, or the like.

Although a certain specific embodiment of the invention has been shown and described, it is obvious that many modifications thereof are possible. The invention therefore, is not intended to be restricted to the exact showing of the drawings and description thereof, but is considered to include reasonable and obvious equivalents.

For example, the slits 18, 18', and **18*a* may be of any selected length; i.e., from being relatively long as shown in FIG. 1 to being relatively short, not shown. Further, there are numerous ways in which the elastic fabric 20 and flap 28 may be attached to the suit. The fabric 20 may be attached to the outer sides of both edges being connected or to the inner sides, with or without the U-shaped sections, 22**, or the fabric could be inserted into slots provided in the confronting surface of the opposed edges between the inner and outer surfaces of the suit. The flap could be attached to either edge of the slit.

What is claimed is:

1. A wet suit for use under water, or the like, comprising a tight form fitting garment of waterproof material having a slit in at least one portion thereof, said slit being closed by a piece of elastic fabric secured to both edges of the slit and a flap of watertight material secured to one edge of the slit and overlapping the other edge of the slit by a substantial amount, whereby said garment is stretchable in the area of the slit while said flap seals against entry of water.

2. A wet suit according to claim 1, wherein said piece of elastic material covers and overlies the slit at the outside of the garment and said flap underlies the slit at the inside of the garment.

3. A wet suit according to claim 2, wherein said flap is formed of the same material as forms said garment.

4. A wet suit according to claim 3, wherein said elastic fabric is a cloth material having considerable more elasticity than the material forming the garment.

5. A wet suit according to claim 4, wherein said flap is secured to the edge of the slit which is closer to the center of the garment.

6. A wet suit according to claim 1, wherein said garment is provided with a plurality of slits in various portions each closed by a piece of elastic fabric and an underlying flap of waterproof material.

7. A wet suit according to claim 6, wherein said slits are provided in the arms and legs of the garment and yield greater flexibility to the garment upon bending at the wearers' elbows and knees.

8. A wet suit according to claim 1, wherein said slit is provided in the trunk of the garment.

9. A wet suit according to claim 1, wherein said elastic fabric is also slit longitudinally and the two sides of a zipper are secured to sides of the slit in the elastic fabric.

10. A wet suit according to claim 9, wherein said slit is provided in the trunk of the garment and closed by the elastic fabric and zipper so that the garment may be more easily put on and taken off and is yieldable to fit wearers of different girth.

11. A wet suit according to claim 7, wherein said arms and legs of said garment have open ends to receive the arms and legs of a wearer, and said slits extended inwardly from the associated open ends.

12. A wet suit according to claim 11, wherein said slits extend over the elbow and knee portions of the garment.

* * * * *